US010014595B2

(12) United States Patent
Paolozzi et al.

(10) Patent No.: US 10,014,595 B2
(45) Date of Patent: Jul. 3, 2018

(54) CONNECTOR ASSEMBLY FOR AN ELECTRICAL DEVICE

(71) Applicants: Alexander Paolozzi, Toronto (CA); Ryan Coelho, Toronto (CA)

(72) Inventors: Alexander Paolozzi, Toronto (CA); Ryan Coelho, Toronto (CA)

( * ) Notice: Subject to any disclaimer, the term of this patent is extended or adjusted under 35 U.S.C. 154(b) by 16 days.

(21) Appl. No.: 15/257,219

(22) Filed: Sep. 6, 2016

(65) Prior Publication Data

US 2017/0040716 A1 Feb. 9, 2017

Related U.S. Application Data

(60) Provisional application No. 62/261,846, filed on Dec. 1, 2015.

(51) Int. Cl.
*H01R 4/28* (2006.01)
*H01R 4/48* (2006.01)

(52) U.S. Cl.
CPC ..... *H01R 4/4836* (2013.01)

(58) Field of Classification Search
CPC ..... H01R 4/50; H01R 4/4836
USPC ..... 439/725
See application file for complete search history.

(56) References Cited

U.S. PATENT DOCUMENTS 6,280,233 B1 8/2001 Beege et al.
6,341,989 B1 * 1/2002 Jaag ..... H01R 4/4827 439/725
6,551,119 B1 4/2003 Sakamoto et al.
6,875,062 B2 * 4/2005 Bouley ..... H01R 4/4827 439/828
7,101,231 B2 * 9/2006 Prokup ..... H01R 4/4809 439/709
7,896,685 B2 * 3/2011 Eppe ..... H01H 1/5844 439/441
7,993,156 B2 * 8/2011 Holste ..... H01R 4/4836 439/441
9,466,911 B1 * 10/2016 Wu ..... H01R 4/4836
9,525,216 B2 * 12/2016 Wu ..... H01R 4/4809
9,614,306 B2 * 4/2017 Hewer ..... H01R 12/7005
9,680,237 B2 * 6/2017 Aporius ..... H01R 4/4809
2008/0158788 A1 * 7/2008 Darr ..... H01H 9/104 361/647
2011/0039455 A1 * 2/2011 Hayashi ..... H01R 4/4863 439/725

(Continued)

*Primary Examiner* — Abdullah Riyami
*Assistant Examiner* — Nader Alhawamdeh
(74) *Attorney, Agent, or Firm* — Sand & Sebolt

(57) ABSTRACT

A wire connector assembly for an electrical device such as a circuit breaker. The assembly includes a housing with electrically conductive fixed and spring contacts located therein and between which a wire may be secured. The spring contact includes a rotatable arm that is biased toward the fixed contact. An electrically non-conductive release actuator is located within the interior of the housing and is rotatable between a first position and a second position when a linear force is applied thereto. When the release actuator is in the first position, a first end of the release actuator is remote from the fixed contact and the spring contact. When the release actuator is moved to the second position, the first end of the release actuator is rotated to be located partially between the fixed contact and the spring contact, opening a gap therebetween and from which the wire may be removed.

31 Claims, 14 Drawing Sheets

(56) References Cited

U.S. PATENT DOCUMENTS

| | | | | |
|---|---|---|---|---|
| 2011/0207361 | A1 | 8/2011 | Heckert et al. | |
| 2011/0223795 | A1* | 9/2011 | Schafmeister ..... | H01R 4/4836 439/370 |
| 2013/0052884 | A1* | 2/2013 | Hanses ..... | H01R 9/2683 439/816 |
| 2016/0056548 | A1* | 2/2016 | Wendt ..... | H01R 4/5008 439/725 |
| 2016/0190713 | A1* | 6/2016 | Wu ..... | H01R 4/4836 439/733.1 |
| 2016/0218450 | A1* | 7/2016 | Wendt ..... | H01R 4/4836 |
| 2016/0352026 | A1* | 12/2016 | Fischer ..... | H01H 5/00 |
| 2017/0040716 | A1* | 2/2017 | Paolozzi ..... | H01R 4/4836 |

* cited by examiner

CONNECTOR ASSEMBLY FOR AN ELECTRICAL DEVICE

CROSS-REFERENCE TO RELATED APPLICATIONS

This application claims the benefit of U.S. Provisional Patent Application No. 62/261,846 filed Dec. 1, 2015, the entire disclosure of which is incorporated herein by reference.

BACKGROUND OF THE INVENTION

Technical Field

The present invention generally relates to electrical devices. More particularly, the invention is directed to circuit breakers and other electrical devices that connect to power sources via wires which must be engaged with the circuit breaker or electrical device. Specifically, this invention is directed to a connector assembly that permits wires to be readily secured in the circuit breaker or electrical device without the use of screws and which permits insertion of a tool through a release port in a front face of the circuit breaker or electrical device for quick and easy disengagement of a secured wire.

Background Information

There are many types of electrical devices that require an electrical connection to wiring carrying 110V, 220V and up to 600V alternating current (AC) in homes and commercial buildings. Many of these electrical devices have screw-type terminals to attach the wires to the device. These electrical devices may include outlets, light switches and circuit breakers that may be installed in a building's electrical panel. The screw-type terminals require that the screw of the terminal be loosened, a stripped end of a wire be wrapped around the screw's shaft, and then the screw be tightened to lock the wire to the terminal. Some of the issues with this type of connection are that it may be difficult to get good electrical contact between the terminal and the wire and that there is a tendency for wire to pull away from the terminal when the device is handled.

This issue has been somewhat addressed in other electrical devices, such as wall outlets and switches, by providing connectors that do not require a screw and are therefore not as cumbersome or time consuming to use. In these particular instances, the electrical device may be connected quite rapidly to a pre-stripped wire of solid and stranded gauges ranging from 14 gauge to 12 gauge or 10 gauge. The type of connection may include two conducting components, namely a spring-steel metal contact and an opposed fixed metal contact. The spring-steel contact is able to move toward and away from the fixed contact. The wire to be connected to the device is inserted through a hole in the device's housing and the wire tends to slightly bend the spring metal contact so that the inserted wire is secured between these two conducting components. The spring-steel contact may be bent and shaped so that the angle of the spring-steel contact relative to the opposing fixed contact is less than 90 degrees. This configuration allows the inserted wire to push the spring metal contact back and away from the fixed contact to open up a space for the inserted wire. The configuration also ensures a removal force that is applied will tend to cause the spring-steel contact to tighten its grip on the wire. This arrangement ensures that the inserted wire may not be accidentally or easily dislodged or removed from the electrical device. Consequently, once the wire is inserted between the spring-steel contact and the fixed contact, the wire may not be able to be removed therefrom. If it is necessary to disengage the wire from the electrical device then the wire must be cut to remove the outlet or switch. Because the wire's end remains secured in the electrical device, the device has to be thrown out and must be replaced with another electrical device. This course of action may be acceptable when the outlet or switch is a $1.00 wall outlet but it is far less acceptable when the electrical device is a $40 to $50 circuit breaker, particularly since this type of rewiring often has to occur when servicing an electrical device such as an electrical distribution box or panel.

To address the need to throw away electrical devices such as circuit breakers because a section of wire is secured therein, screwless circuit breakers have been proposed in the art. Such screwless electrical device may have a wire-release ports where a screwdriver or similar tool may be inserted into a slot or hole to release a secured wire. The screwdriver is used to push linearly on a plastic, non-conducting part of the circuit breaker. The linear movement of the plastic part tends to open the metal spring contact slightly so that the previously secured wire may be removed. There is, however, a considerable safety issue with this type of circuit breaker or electrical device because the metal spring-steel contact carries 110V, 220V or 600V AC. If the user accidentally touches the live spring-steel contact they may be accidentally electrocuted.

In other circuit breakers, in order to access provided breaker release ports, the circuit breaker must be completely removed from the electrical panel or machinery in order to access the release port. This makes the removal of the wire from the circuit breaker a time consuming and therefore money consuming task. Still further, other circuit breakers have wire-release systems that have complex multiple-part release systems. These systems are more complicated and expensive to fabricate and may be more prone to failure.

SUMMARY

There is therefore a need in the art for an improved apparatus and method that allows for ease of insertion of wires into an electrical device but which also allows secured wires to be safely and easily disengaged from the electrical device when desired.

The apparatus and method disclosed herein addresses and overcomes at least some of the shortcomings of previously known devices and methods. The terms "electrical device" and "circuit breaker" as used herein should be understood to encompass any type of electrical device to which wires must be engaged in order to connect the device to a power source.

In the disclosed electrical device, a release port is provided that is conveniently located on a front face of the electrical device. There is also a single plastic release actuator provided in the release port. A screwdriver or other tool or implement may be inserted into the release port and may be pushed inwardly in a linear direction towards a rear wall of the electrical device. An end of the plastic actuator pushes on a metal spring contact within the interior of the circuit breaker. However, while the release actuator receives a linear input or force from the screwdriver, the release actuator rotates in response to the application of this linear force. As the release actuator rotates, an end of the release actuator moves to a position where it pushes on a metal spring contact. The end of the release actuator causes the spring contact to rotate away from a fixed contact, thereby opening up a gap between the fixed contact and the spring contact and thereby releases the wire that was previously secured between the spring contact and the fixed contact. The rotational motion of the release actuator and of the spring contact ensures that the tip of the screwdriver that is inserted into the release port of the circuit breaker does not and cannot come into contact with the live fixed contact and thereby accidentally electrocute the person holding the screwdriver.

In one aspect, the invention may provide a method of disengaging a wire from an electrical device comprising the steps of providing an electrical device comprising a housing, a fixed contact and a spring contact located within the housing, wherein an end of the wire is secured between the fixed contact and the spring contact; and a release actuator located within the housing, said release actuator being movable between a first position and a second position within the housing; inserting an end of a tool through a release portion defined in an exterior wall of the housing; engaging the release actuator within the housing with the end of the tool and when the release actuator is in the first position; applying a linear force to the release actuator with the end of the tool; rotating the release actuator in response to the applied linear force; moving a release portion of the release actuator between the fixed contact and the spring contact as the release actuator moves into the second position; rotating a region of the spring contact away from the fixed contact; releasing the secured end of the wire from between the fixed contact and the spring contact; and withdrawing the end of the wire from the housing.

In another aspect the invention may provide a wire connector assembly for an electrical device; said connector assembly comprising: a housing; an electrically conductive fixed contact located within an interior of the housing; an electrically conductive spring contact located within an interior of the housing, said spring contact having an arm that is movable toward or away from the fixed contact; and wherein the arm is biased toward the fixed contact; an electrically non-conductive release actuator located within the interior of the housing and being rotatable between a first position and a second position when a force is applied thereto; wherein when the release actuator is in the first position, a first end of the release actuator is remote from the fixed contact and the spring contact; and wherein when the release actuator is in the second position, the first end of the release actuator is located at least partially between the fixed contact and the spring contact.

BRIEF DESCRIPTION OF THE SEVERAL VIEWS OF THE DRAWINGS

A sample embodiment of the invention is set forth in the following description, is shown in the drawings and is particularly and distinctly pointed out and set forth in the appended claims.

Similar numbers refer to similar parts throughout the drawings.

DETAILED DESCRIPTION

Figure 1:
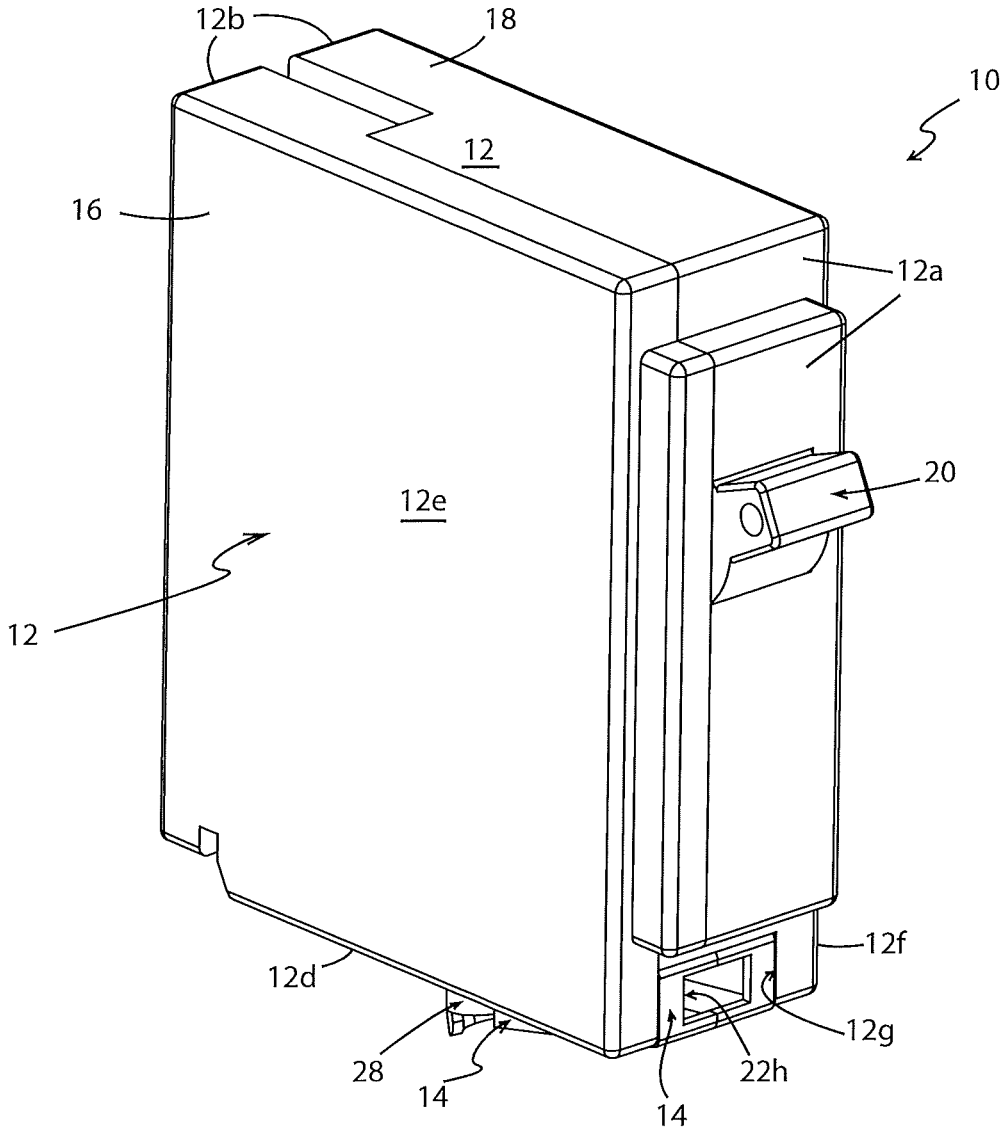
FIG. 1 is a top perspective view of a circuit breaker in accordance with an aspect of the present invention.
Figure 2:
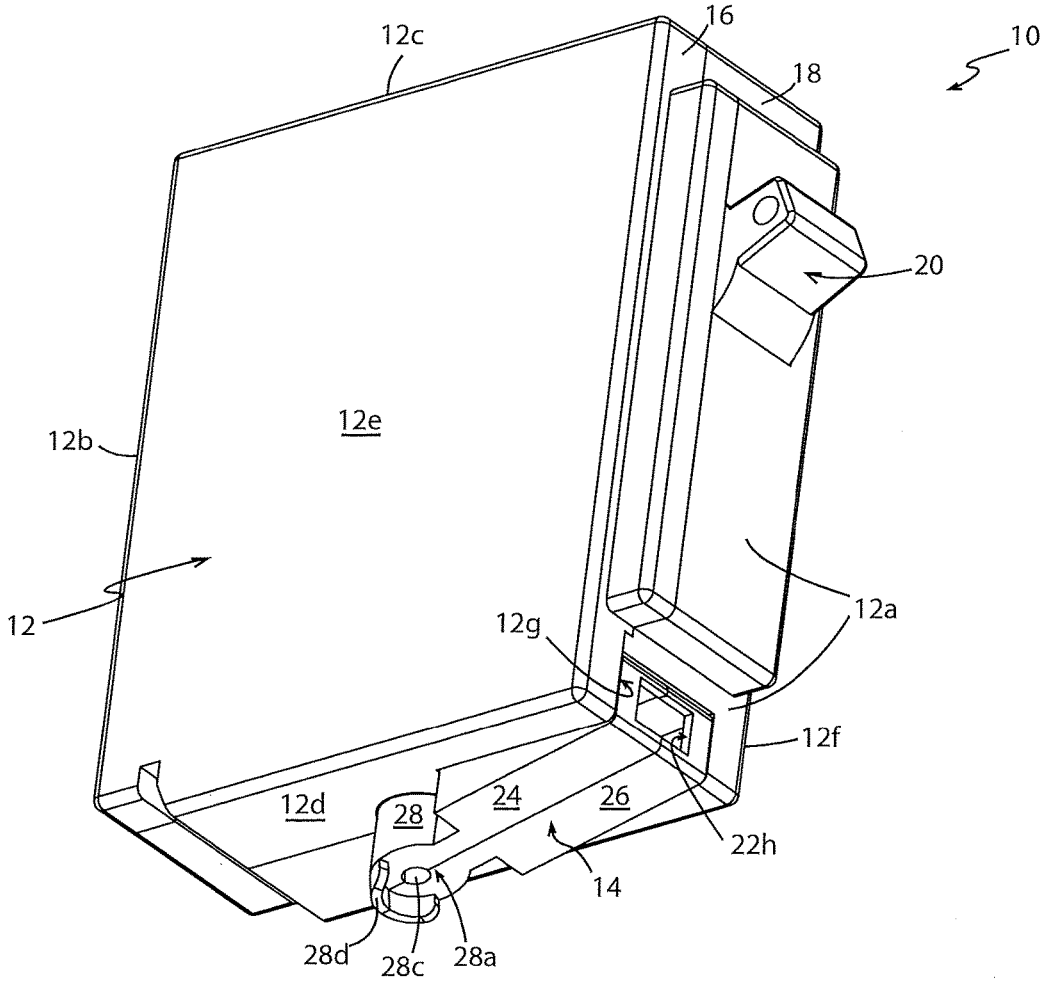
FIG. 2 is a bottom perspective view of the circuit breaker.

Referring to FIGS. 1-11, there is shown a circuit breaker in accordance with an aspect of the present invention generally indicated at 10. Circuit breaker 10 includes a circuit breaker housing 12 and a connector assembly 14 that is engaged with circuit breaker housing 12. Circuit breaker housing 12 is comprised of a first housing section 16 and a second housing section 18 that are configured to interlockingly engage each other to form circuit breaker housing 12. Circuit breaker housing 12 has a front wall 12*a*, a rear wall 12*b*, a top wall 12*c*, a bottom wall 12*d*, a left side wall 12*e* and a right side wall 12*f*. A channel 12*g* is defined in bottom wall 12*d* and this channel 12*g* originates in front wall 12*a* and extends rearwardly towards rear wall 12*b* terminating a distance therefrom (see FIG. 2).

Figure 5:
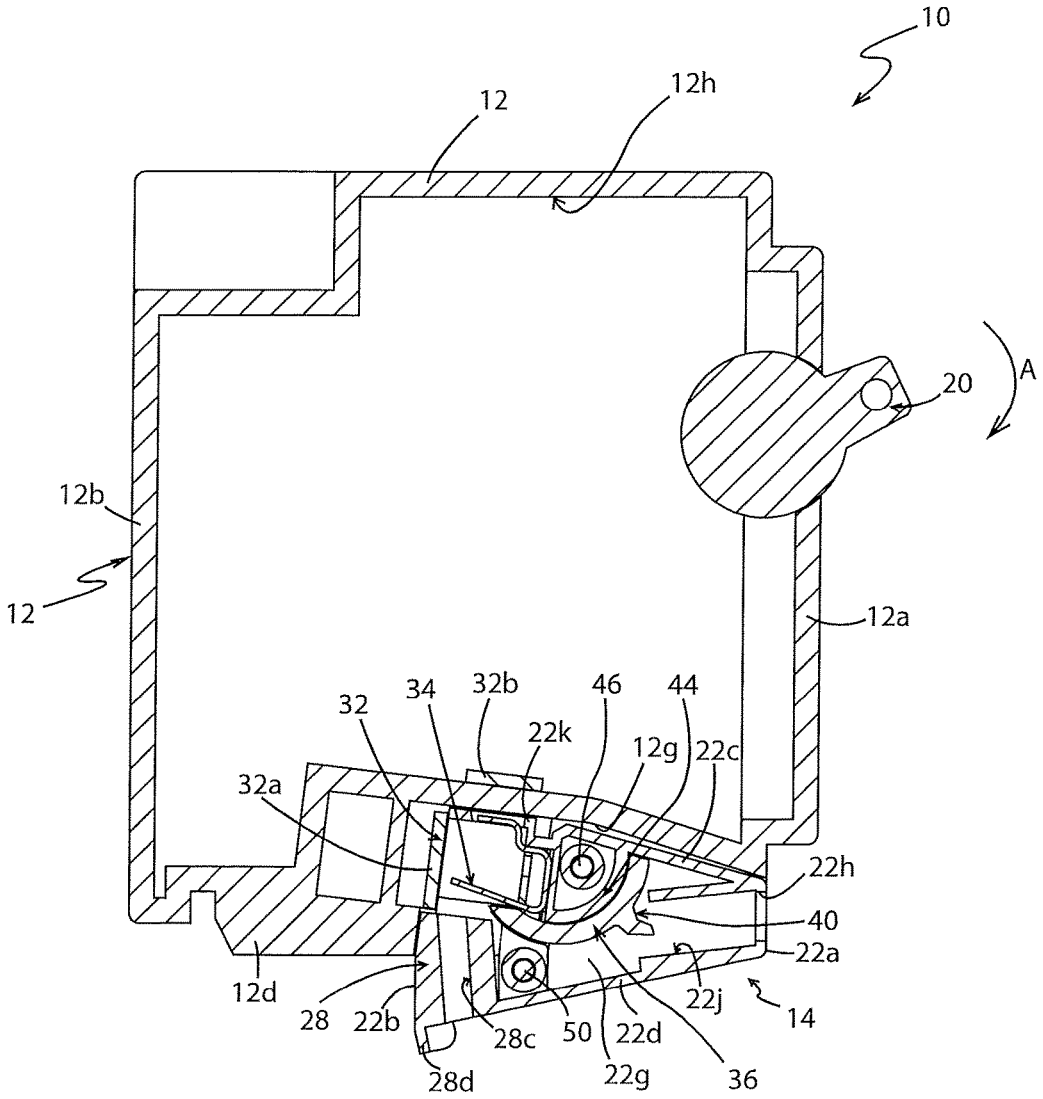
FIG. 5 is a longitudinal cross-section of the circuit breaker taken along line 5-5 of FIG. 4 showing the connector assembly prior to insertion of a wire therein.

Front wall 12*a*, rear wall 12*b*, top wall 12*c*, bottom wall 12*d* and left and right side walls 12*e*, 12*f* bound and define an interior compartment 12*h* (FIG. 5). Various components that enable circuit breaker 10 to function to complete or break an electrical circuit are retained within compartment 12*h*. The present disclosure is directed to an improved mechanism for connecting external wiring to circuit breaker 10 and for releasing this wiring therefrom. The components housed within compartment 12*h* that enable circuit breaker 10 to function are not of relevance to the engagement/release mechanism disclosed herein. Furthermore, these components within the interior compartment 12*h* of circuit breaker 10 are well known in the art and, as a consequence, most of these components are not illustrated or described herein. The only one of the components that is illustrated herein is a switch 20 that extends partially outwardly from front wall 12*a* of circuit breaker 10. When switch 20 is in a first position (FIG. 1), the electrical circuit that circuit breaker 10 forms a part of is closed and current flows through circuit breaker 10. When switch 20 is rotated to a second position by moving it in the direction indicated by arrow "A" (FIG. 5), the electrical circuit is broken and current no longer flows through that electrical circuit and through circuit breaker 10.

As indicated earlier herein, connector assembly 14 is engaged in channel 12*g* of circuit breaker housing 12.

Figure 3:
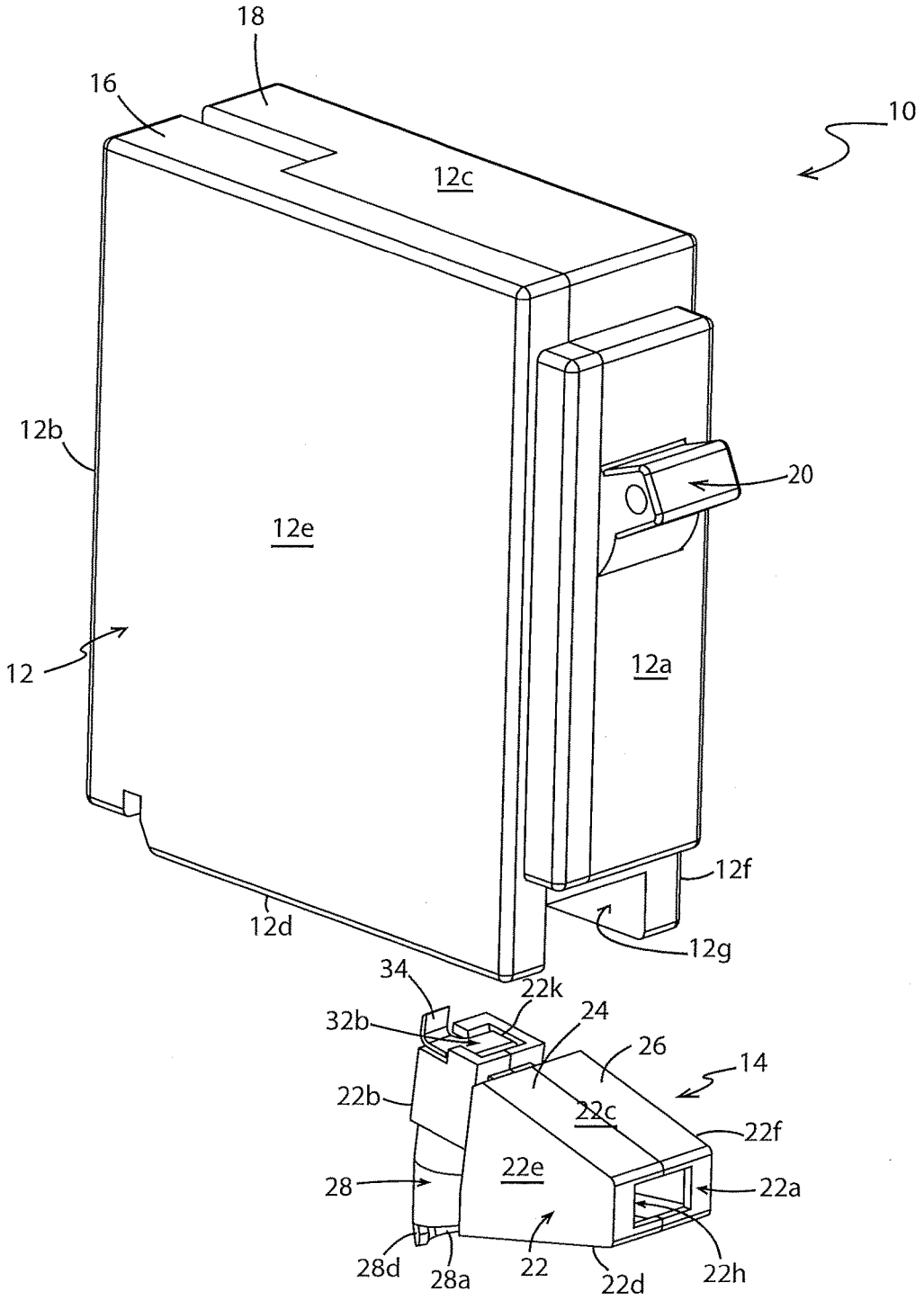
FIG. 3 is a top perspective view of the circuit breaker showing the connector assembly exploded away from the circuit breaker housing.
Figure 7:
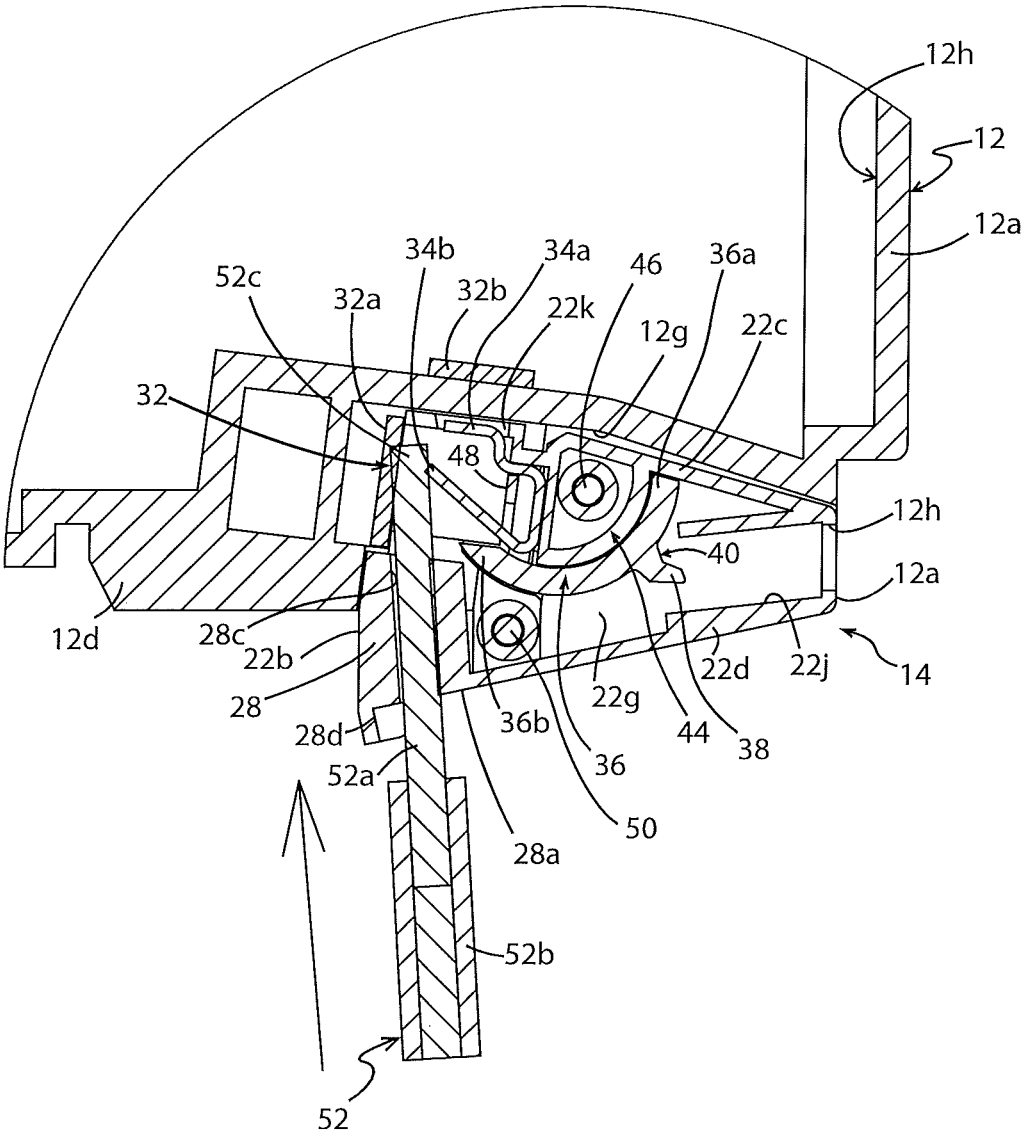
FIG. 7 is an enlargement of the highlighted region of the longitudinal cross-section of the circuit breaker shown in FIG. 5 and showing the connector assembly after the insertion of a wire therein.

Connector assembly 14 includes a connector assembly housing 22 comprised of a first housing release portion 24 (FIG. 3) and a second housing release portion 26. First housing release portion 24 and second housing release portion 26 are configured to interlockingly engage each other. Connector assembly housing 22 has a front wall 22*a*, a rear wall 22*b*, a top wall 22*c*, a bottom wall 22*d*, a left side wall 22*e* and a right side wall 22*f*. Front wall 22*a*, rear wall 22*b*, top wall 22*c*, bottom wall 22*d*, and left and right side walls 22*e*, 22*f* bound and define an interior cavity 22*g* (FIG. 7). As shown in FIG. 3, an opening 22*h* is defined in front wall 22*a* and this opening 22*h* is in fluid communication with interior cavity 22*g* via a passageway 22*j* (FIG. 7). An aperture 22*k* is defined in top wall 22*c* of connector assembly housing 22. Aperture 22*k* is also in fluid communication with interior cavity 22*g*.

Connector assembly housing 22 is shaped to include a generally cylindrical region identified in FIG. 1 and FIG. 7 by the reference number 28. Cylindrical region 28 has a bottom end 28*a* and a top end 28*b* (FIGS. 3 and 3B). Cylindrical region 28 defines a slot 28*c* therein. Slot 28*c* extends from bottom end 28*a* to top end 28*b*. Slot 28*c* is in fluid communication with interior cavity 22*g*. Cylindrical region 28 also includes a flange 28*d* that extends outwardly downwardly for a distance beyond bottom wall 22*d* of connector assembly housing 22. Flange 28*d* may be curved and is generally semi-circular. Flange 28*d* may have a radius of curvature that is complementary to the radius of curvature of the exterior wall of cylindrical region 28. Flange 28*d* is spaced a distance outwardly away from the opening to slot 28*c* in bottom end 28*a* of cylindrical region 28.

Connector assembly housing 22 is further shaped to include a generally cubic region that extends upwardly from the top end 28*b* of the generally cylindrical region. Aperture 22*k* is defined in an uppermost region of this generally cubic region. Connector assembly housing may further includes a generally triangularly-shaped region (when viewed from the side in FIGS. 2 and 3). An upper section of the triangularly-shaped region is received within channel 12*g* of circuit breaker housing 12 when connector assembly 14 is received within channel 12*g*. A lower section of triangularly-shaped region extends downwardly and outwardly from bottom wall 12*d* of circuit breaker housing 12. Opening 12*h* to interior cavity 12*g* is defined in the front face 22*a* of this triangularly-shaped region.

It will be understood that while the connector assembly housing has been described and illustrated as a separate component that is received within channel 12*g* of circuit breaker housing 12, it will be understood that connector assembly housing and circuit breaker housing 12 may be molded together so that the circuit breaker housing simply has a first half and a second half and each of these halves includes a region that covers the circuit breaker components as well as the components discussed herein as being located within the connector housing assembly. In other words, the separate housing sections 16 and 24 may be molded to form a single cover and the sections 18 and 26 may be molded to form another single cover and then these two single covers may be joined together to form the housing of the device.

Figure 3A:
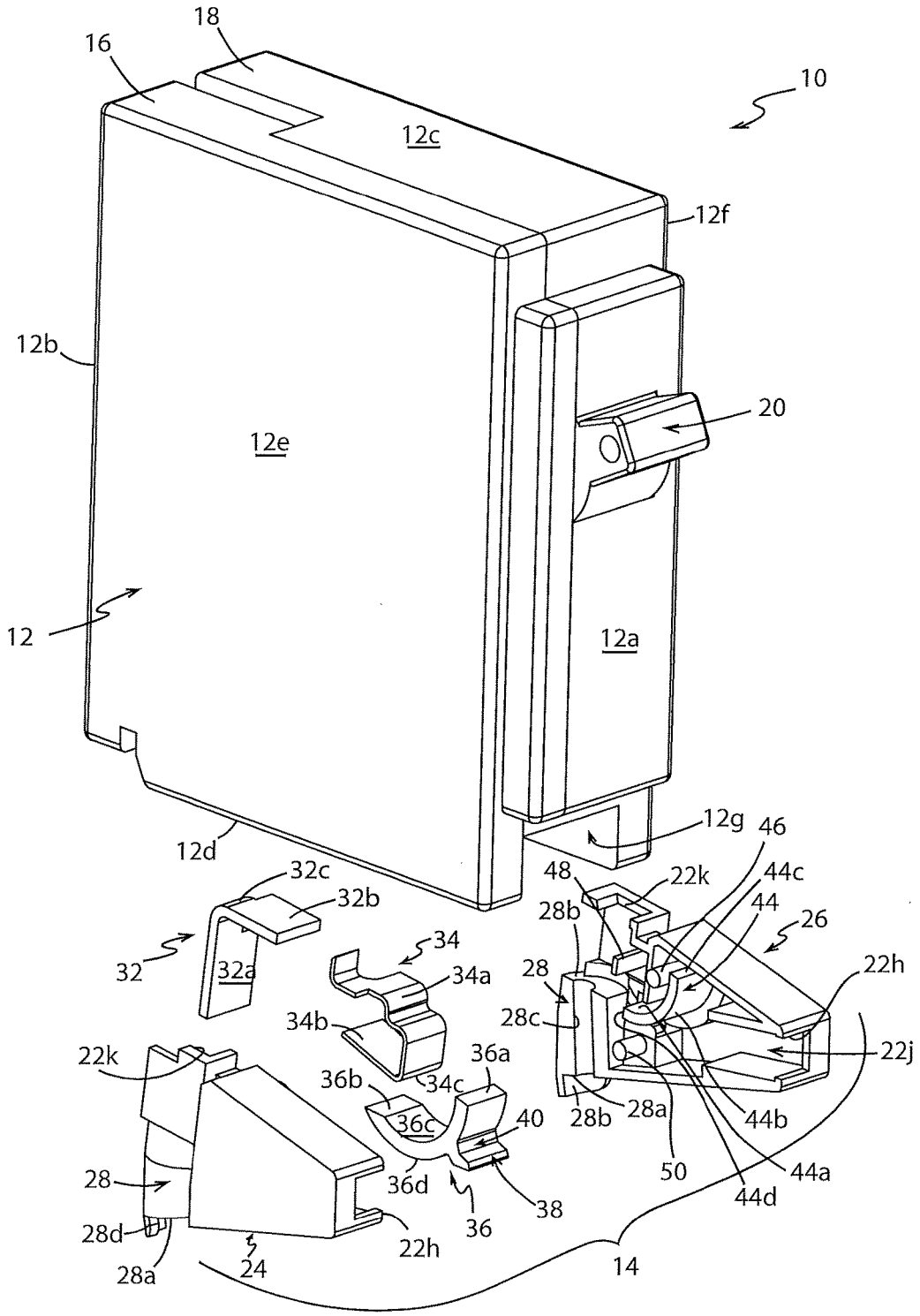
FIG. 3A is a top perspective view of the circuit breaker as shown in FIG. 3 but with the connector assembly exploded to show the component parts thereof.
Figure 3B:
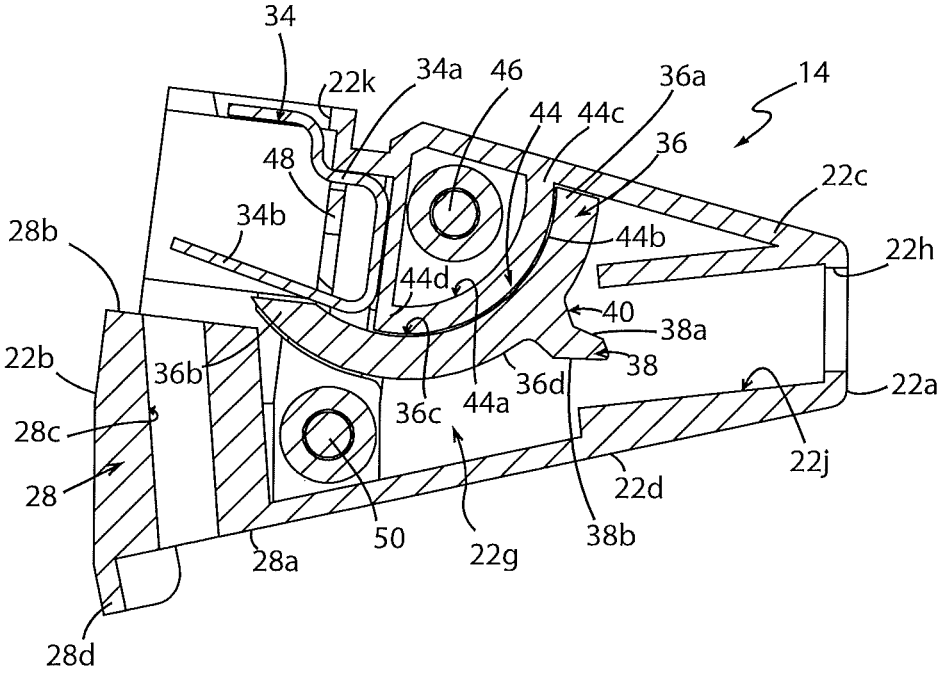
FIG. 3B is a longitudinal section of the connector assembly alone taken along line 3B-3B of FIG. 3.
Figure 3C:
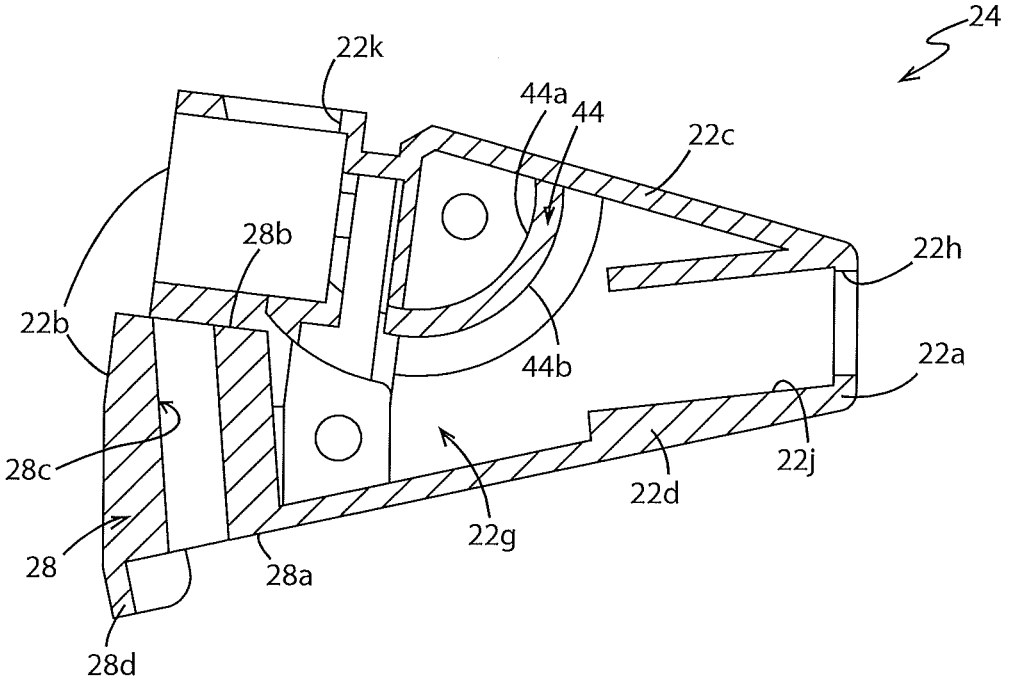
FIG. 3C is a top perspective view of an interior of a first housing release portion of the connector assembly.
Figure 4:
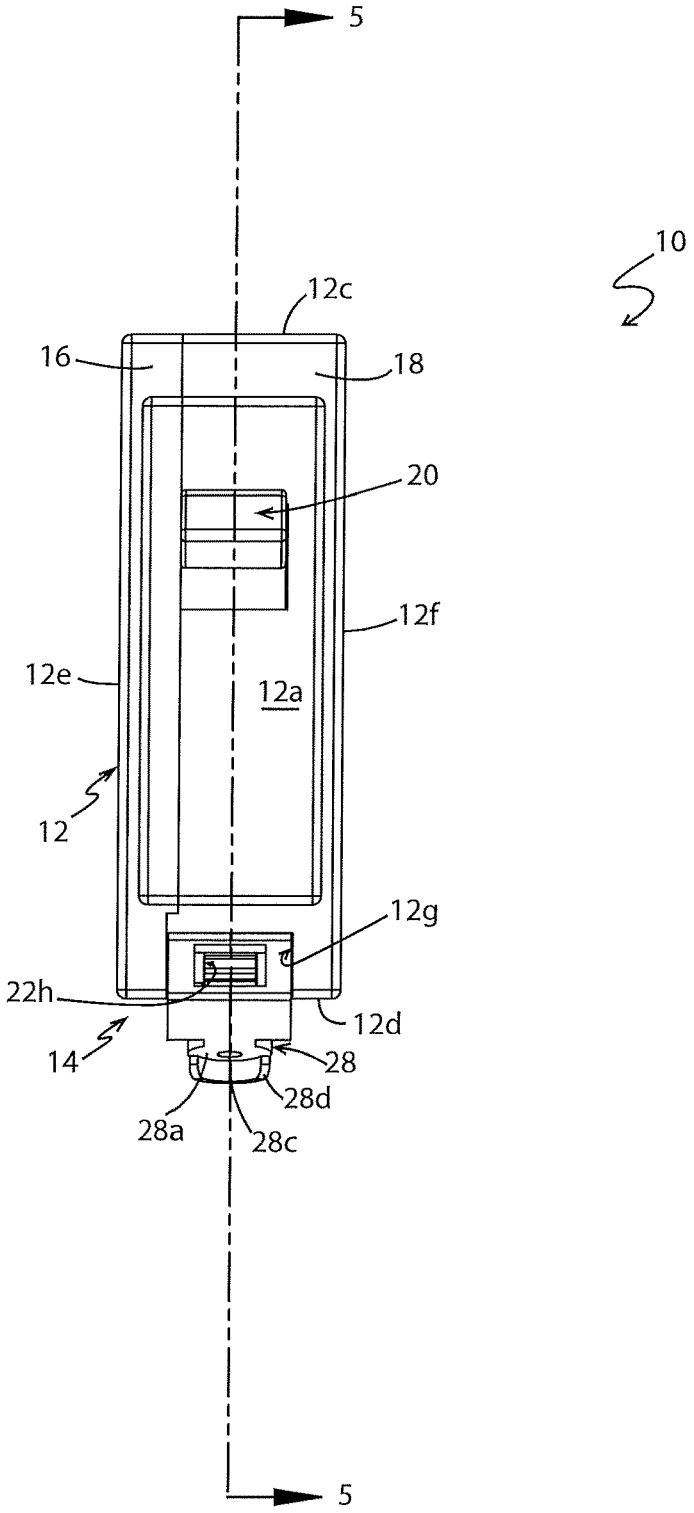
FIG. 4 is a front elevation view of the circuit breaker.
Figure 10:
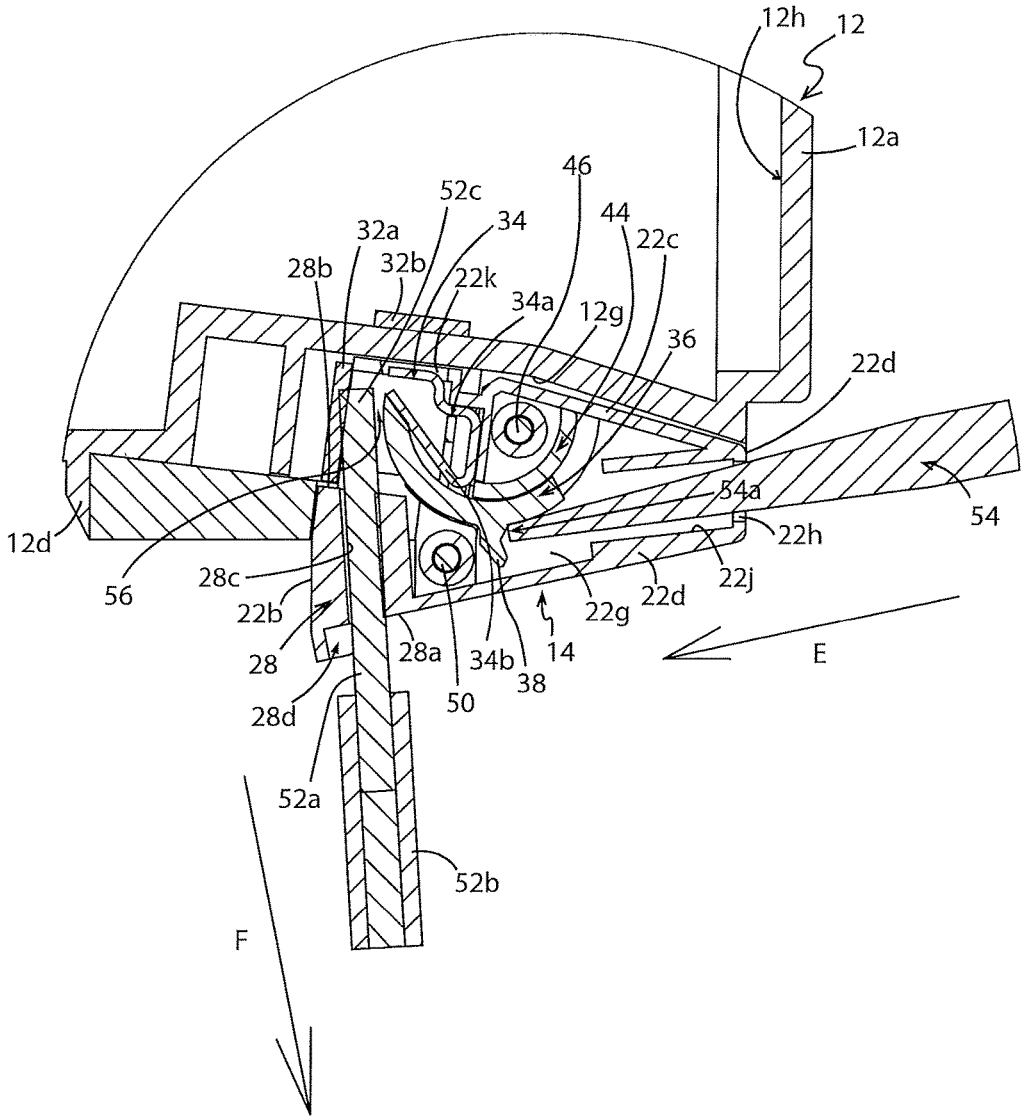
FIG. 10 is an enlargement of the highlighted region of the longitudinal cross-section of the circuit breaker shown in FIG. 5 and showing a release tool inserted into the connector assembly to disengage the wire therefrom.

As best seen in FIGS. 3-3C and in FIGS. 7 and 10, connector assembly 14 includes a fixed contact and a spring contact, both of which may be fabricated from metal and are thereby electrically conductive. The fixed contact may be in the form of a breaker contact plate 32 that is generally L-shaped having a first leg 32*a* and a second leg 32*b* that are oriented generally at right angles to each other. A slot 32*c* is defined in second leg 32*b* proximate the intersection of first leg 32*a* and second leg 32*b* (see FIG. 3B). When connector assembly 14 is in an assembled position as in FIG. 3B, a lowermost end of first leg 32*a* is seated upon upper end 28*b* of cylindrical region 28. FIG. 3 also shows that at least a part of second leg 32*b* extends across aperture 22*k* in connector assembly housing 22. Second leg 32*b* of breaker contact plate 32 is in electrical contact with the functioning components within the interior compartment 12*h* of circuit breaker circuit breaker housing 12. This will be discussed further later herein.

The spring contact in connector assembly 14 may take the form of a spring 34 that is of any suitable configuration that will allow for movement toward and away from the fixed contact, i.e., breaker contact plate 32 and will all for the engagement and release of an end of a wire between the spring 34 and breaker contact plate 32. As illustrated in the attached figures, spring 34 may be a flat spring and may include a main body release portion 34*a* (FIG. 8) and an arm 34*b* that is able to move toward main body release portion 34*a* (as indicated by the arrow "B" in FIG. 8) and away therefrom in a direction opposite to arrow "B". Arm 34*b* rotates about an axis that extends through corner 34*c* (FIGS. 8 and 11) of spring 34. It should be noted that in connector assembly 14, the only electrically conductive components are breaker contact plate 32 and spring 34. All other parts of connector assembly 14 are fabricated from an electrically non-conductive material such as plastic. The parts of connector assembly 14 other than breaker contact plate 32 and spring 34 may be injection molded plastic.

Figure 8:
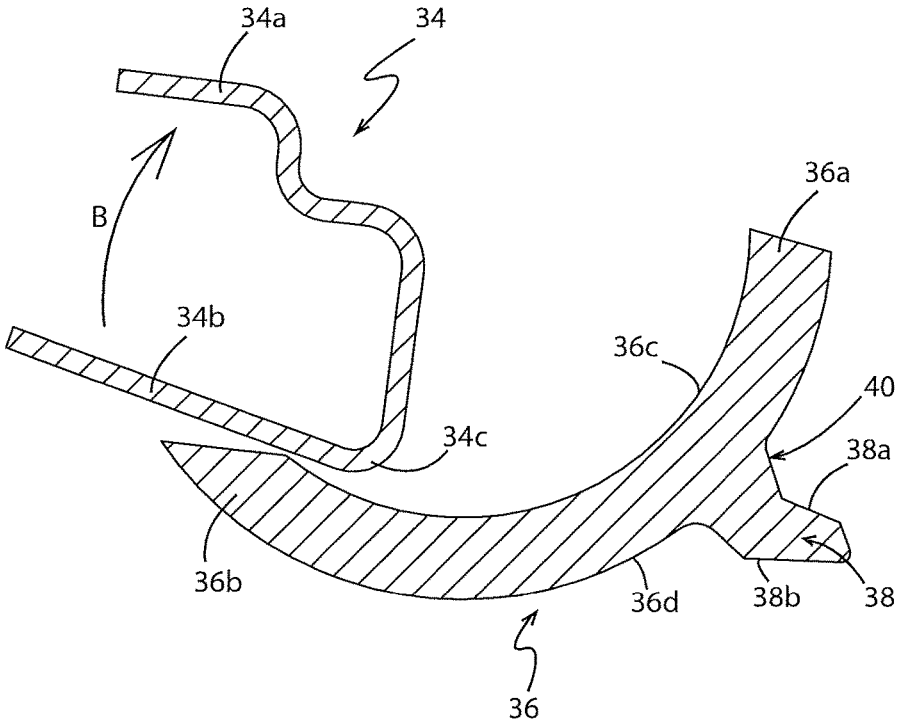
FIG. 8 is an enlarged cross-sectional view of only the spring contact and the actuator in a rest state ready to receive a wire.
Figure 9:
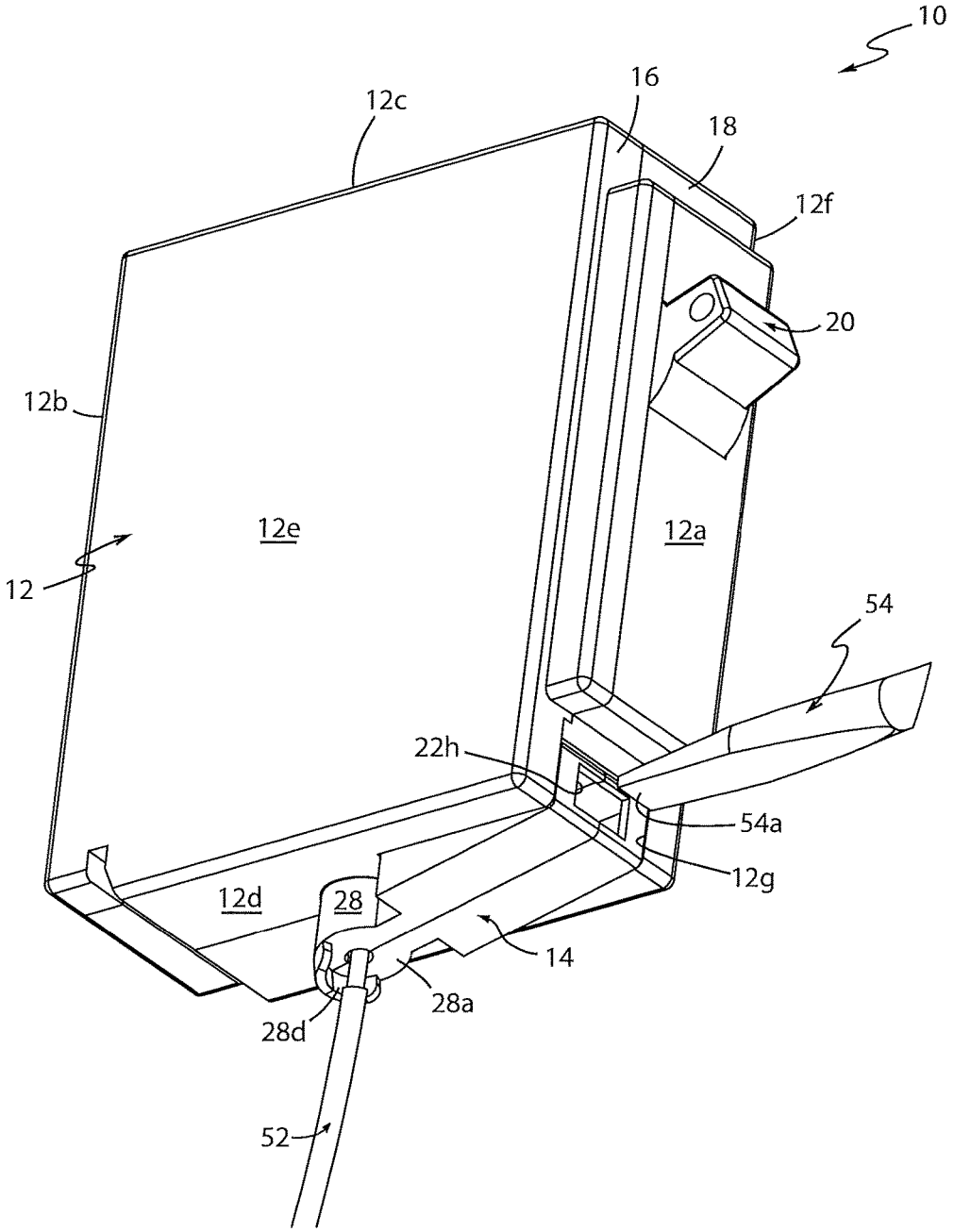
FIG. 9 is a bottom perspective view of the circuit breaker showing the wire installed therein and showing an implement inserted into the release port to disengage the wire from the circuit breaker.

Connector assembly 14 further includes a release actuator 36. Release actuator 36 is located within connector assembly such that it is aligned with release port 22*h* and is located so as to be able to be contacted with a tool that is inserted through release port 22*h*, as will be described later herein. Release actuator 36 is fabricated from an insulating or non-conductive material such as plastic. Release actuator 36 is a single, unitary, monolithic component. Release actuator 36 may comprise a generally semi-circular base 36 that has a first end 36*a* and a second end 36*b*, an interior surface 36*c* and an exterior surface 36*d*. A flange 38 extends outwardly from exterior surface 36*d* at a position that may be closer to first end 36*a* than to second end 36*b*. Flange 38 has a first surface 38*a* that faces first end 36*a* of base 36 and a second surface 38*b* that faces second end 36*b*. A notch 40 is defined between first surface 38*a* of flange 38 and exterior surface 36*d* of base 36. As best seen in FIG. 8, first end 36*a* of base 36 is generally oriented at right angles to each of the interior and exterior surfaces 36*c*, 36*d* of base 36. Second end 36*b* of base 36 is oriented at an angle $\alpha$ relative to interior surface 36*c* and exterior surface 36*d* of base. Angle $\alpha$ is an angle other than ninety degrees. By way of example only, second end 36*b* of base 36 may be oriented at an angle $\alpha$ of about 120° relative to interior surface 36*c* and at an angle $\alpha$ of about 30° relative to exterior surface 36*d*. This angled second end 36*b* will be positioned to contact an exterior face of arm 34*b* of spring 34 as may be seen in FIG. 11.

One or both of first housing release portion 26 or second housing release portion 28 is provided with guide components that are molded into the interior surface of the respective housing release portion 26 or 28. A first guide component comprises a detent 44 that extends outwardly from an interior surface of right side wall 22*f* of first housing release portion 26. Detent 44 is fixedly engaged with the interior surface of right side wall 22*f* and is molded therewith when first housing release portion 26 is fabricated. Detent 44 has an interior surface 44*a* (FIGS. 3A and 3B), an exterior surface 44*b*, a first end that 44*c* adjacent an interior surface of top wall 22*c* of connector assembly connector assembly housing 22; and a second end 44*d* that is remote from the interior surface of top wall 22*c*. Exterior surface 44*b* of detent 44 is curved in such a manner that surface 44*b* is complementary to the curved interior surface 36*c* of release actuator 36. In other words, exterior surface 44*b* has a radius of curvature substantially identical to a radius of curvature of interior surface 36*c* of release actuator 36. When connector assembly 14 is assembled, interior surface 36*c* of base 36 is in direct contact with exterior surface 44*a* of detent 44.

When release actuator 36 is actuated (as will be described later herein), the actuator 36 moves (i.e., such as by sliding) along the exterior surface 44*a* of detent 44 and thus moves along an arcuate path within the interior chamber 22*h* of connector assembly connector assembly housing 22 in a first direction (indicated by arrow "D" in FIG. 11). While detent 44 and base 36 have substantially identical radii of curvature, detent 44 is not as long as base 36 where the length of detent 44 is measured between first end 44*c* and second end 44*d*; and the length of base 36 is measured between first end 36*c* and second end 36*d*. This difference in lengths between base 36 and detent 44 may be seen in FIG. 7 where it is evident that a release portion of the base 36 extends for a distance outwardly beyond second end 44*d*.

Referring to FIGS. 3A and 3B, a first boss 46, a plate 48, and a second boss extend into interior cavity 22*g* from an interior surface of right side wall 22*f* of first housing release portion 26 a distance away from detent 44. Second boss 50 is positioned a distance below second end 44*b* of detent 44. Detent 44, first boss 46, plate 48 and second boss 50 aid in correctly positioning the base 36 of the release actuator and spring 34 within the interior cavity 22*g*. Second boss 50 is located such that when base 36 is moved within interior cavity 22*g*, as will be described later herein, flange 40 may contact second boss 50 and any further motion of flange 40 will be halted.

Figure 6:
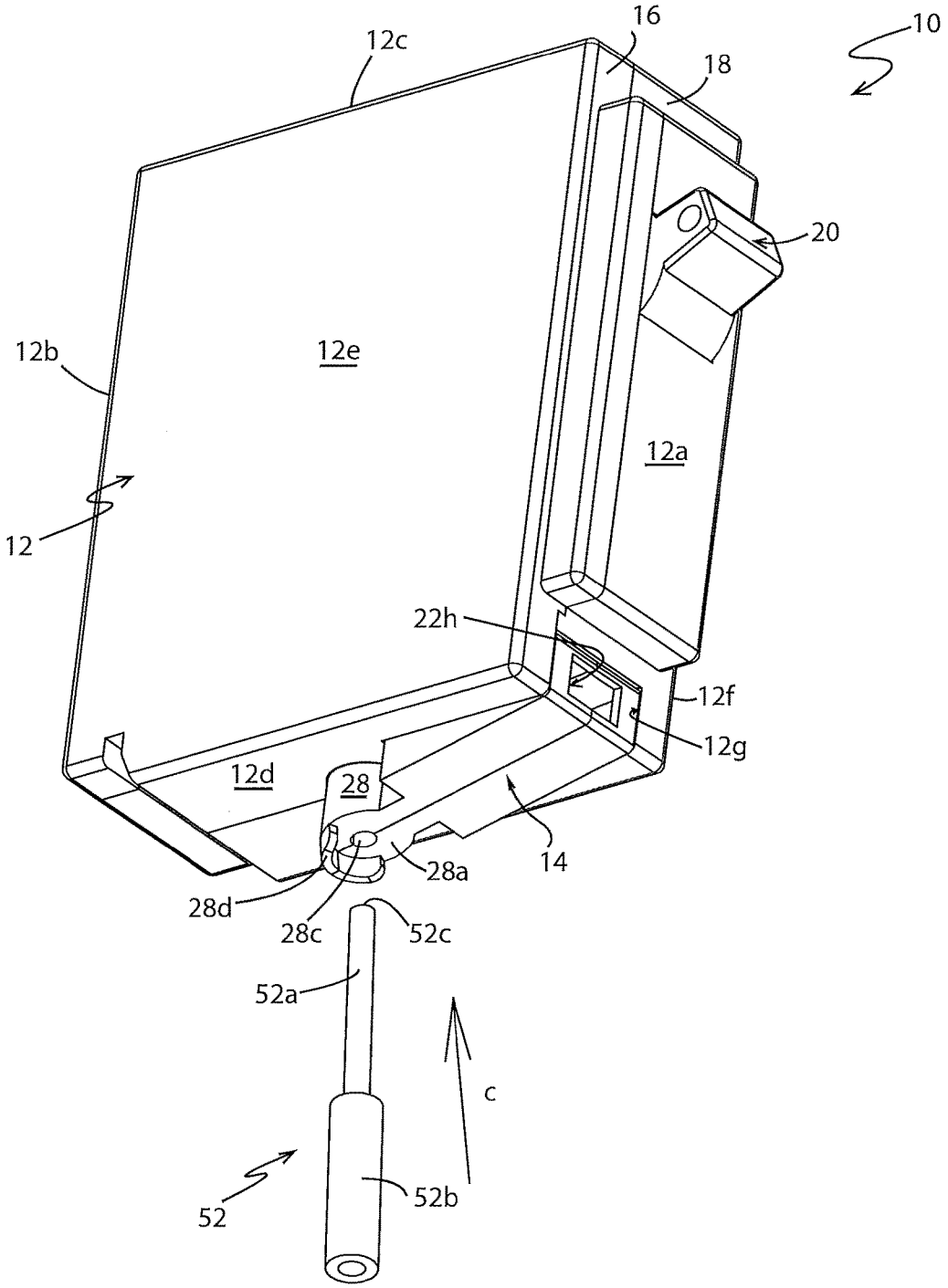
FIG. 6 is a bottom perspective view of the circuit breaker showing a pre-stripped wire being inserted into the insertion release port in a bottom wall.

As indicated earlier herein connector assembly 14 is engaged within channel 12*g* of circuit breaker circuit breaker housing 12. Connector assembly 14 is used in the following manner to engage a wire 52 (FIG. 6) from an electrical device or appliance (which electrical device or appliance is not illustrated herein). Wire 52 includes an end 52*a* from which an insulating sleeve 52*b* has been stripped. Wire 52 is, obviously, of a size that is able to be received through slot 28*a* in cylindrical region 28 of connector assembly 14. FIGS. 6 and 7 show the end 52*a* of wire 52 being inserted into slot 28*a* in the direction of arrow "C". Wire 52 is moved upwardly through slot 28*a*. As end 52*a* of wire 52 is inserted and moves upwardly in the direction of arrow "C", a release portion of end 52*a* contacts arm 34*b* of spring 34 and pushes the same in the direction of arrow "B" (FIG. 8). Movement of end 52*a* of wire 52 continues until the tip 52*c* and a region of wire 52 below tip 52*c* contacts a region of first leg 32*b* or second leg 32*a* of breaker contact plate 32 and motion in the direction of arrow "C" is caused to stop. At this point, end 52*a* of wire is trapped between arm 34*b* of spring 34 and first leg 32*a* of breaker contact plate 32. Since wire 52 is designed to carry current, the securement of end 52*a* of wire against breaker contact plate 32 ensures that wire 52 and breaker contact plate 32 are electrically connected together and current from wire 52 will flow into breaker contact plate 32 and thereby through second leg 32*b* thereof an interior the electrically connected components within circuit breaker housing's compartment 12*g*.

When it is desired to disconnect wire 52 from circuit breaker 10, an end 54 of an actuating tool such a flat-head screwdriver (not shown herein) is inserted through opening 22*h* defined in connector assembly's front face 22*a* and into passageway 22*j*. End 54 of tool is moved linearly in the direction of arrow "E" (FIGS. 10 and 11) until the tip 54*a* thereof becomes seated within notch 40 of release actuator 36. One of the advantages of seating the end 54 of tool in notch 40 is that the end 54 of tool is prevented from contacting any of the electrically conductive components such as the end of wire 52*a* and breaker contact plate 32. This is because flange 38 is adjacent one side of the end 54 and the exterior surface 36*d* of base 36 is adjacent the other side of the end 54. Consequently, end 54 is substantially surrounded and shielded by electrically non-conductive material. This configuration substantially prevents the possibility of an electrical arc within connector assembly 14 and thereby helps ensure the safety of the person removing wire 52 from circuit breaker 10. Continued movement of the end 54 of the tool in the direction of arrow "E" causes the base of release actuator 36 to slide along exterior surface 44*a* of detent 44, thus moving in a circular or arcuate pathway in the direction of arrow "D" (FIG. 11). Base 36 continues to rotate in the direction of arrow "D" until flange 38 engages second boss 50 and the rotational motion of base 36 ceases. Second boss 50 thus acts as a stop that prevents further rotational motion of base 36. Additionally, the second boss 50 and flange 38 form a barrier past which end 54 of tool cannot move. Thus, there is little to no possibility that the end 54 of the metal tool will contact an of the electrically conductive components located within connector assembly 14.

As base 36 rotates in the direction indicated by arrow "D" the second end 36*b* of base 36 is progressively inserted between arm 34*b* of spring 34 and breaker contact plate 32, i.e., between the spring contact 34 and the fixed contact 32. Second end 36*b* of base 36 is angled, as indicated earlier herein and the angled second end 36*b* pushes and moves arm 34*b* further in the direction of arrow "B". The force applied by second end 36*b* of base 36 on arm 34*b* causes arm 34*b* to rotate away from second leg 32*a* of breaker contact plate 32, thereby opening up a gap 56 (FIG. 10) between arm 34*b* and second leg 32*a* of breaker contact plate 32. End 52*a* of wire 52 is therefore no longer secured between arm 34*b* and second leg 32*a*. As long as tool is engaged in notch 38, arm 34*b* is maintained a distance away from end 52*a* of wire 52. End 52*a* of wire 52 may thereby be quickly and easily withdrawn from slot 28*c* by pulling downwardly on wire 52 in the direction of arrow "F" (FIG. 10) until end 52*a* of wire 52 is withdrawn from connector assembly 14 and thus from circuit breaker 10.

Figure 11:
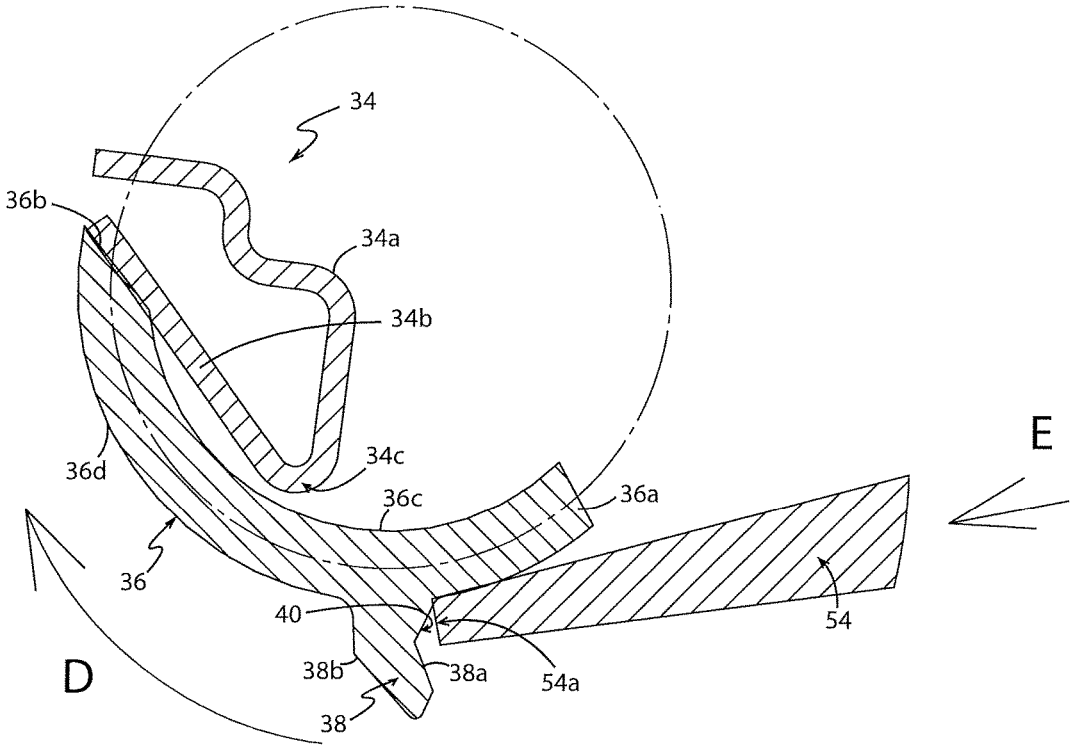
FIG. 11 is an enlarged cross-sectional of only the spring contact and the actuator in a release position.

Once end 52*a* of wire 52 exits connector assembly 14, the tool may be withdrawn from connector assembly 14 by moving tool in the opposite direction to arrow "E" (FIGS. 10 and 11). As the end 54 of tool is withdrawn through passageway 22*j*, arm 34*b* of spring 34 returns to its at rest position, moving in the opposite direction to arrow "B" (FIG. 8), and as it does so, arm 34*b* forces release actuator 36 to rotate in the opposite direction to arrow "D" (FIG. 11), moving (i.e., sliding) along detent 44 as it does so. As actuator 36 returns to the at rest position, arm 34*a* of spring returns to a position where it is once again in contact with breaker contact plate 32.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration set out herein are an example and the invention is not limited to the exact details shown or described.

The invention claimed is:

1. A method of disengaging a secured wire from an electrical device comprising:

providing an electrical device comprising a housing, a fixed contact and a spring contact located within the housing, wherein an end of the wire is secured between the fixed contact and the spring contact; said electrical device further comprising a release actuator located entirely within an interior cavity of the housing, said release actuator including a region that is accessible through an opening defined in an exterior wall of the housing; said release actuator being selectively rotatable between a first position and a second position within the interior cavity of the housing;

inserting an end of a tool through the opening defined in the exterior wall of the housing;

engaging the region of the release actuator within the interior cavity of the housing with the end of the tool when the release actuator is in the first position;

rotating the release actuator from the first position to the second position;

deflecting a portion of the spring contact with the release actuator; and releasing the secured end of the wire from between the fixed contact and the deflected portion of the spring contact; and withdrawing the end of the wire from the housing.

2. The method as defined in claim 1, further comprising the step of: applying a linear force to the release actuator with the end of the inserted tool.

3. The method as defined in claim 2, wherein the step of rotating the release actuator from the first position to the second position is in response to the applied linear force.

4. The method as defined in claim 3, further comprising the step of:

moving the release portion of the release actuator between the fixed contact and the spring contact as the release actuator moves into the second position.

5. The method as defined in claim 4, further comprising the step of:

rotating a region of the spring contact from an initial position to a final position and in a direction away from the fixed contact.

6. The method as defined in claim 1, wherein the step of inserting the end of the tool includes inserting the end of the tool through the release port that is defined in a front wall of the housing and into the interior cavity of the housing.

7. The method as defined in claim 1, wherein the region of the release actuator that is contacted is a flange that extends outwardly from an exterior surface of the release actuator, and the step of engaging the end of the tool with the release actuator includes:

inserting the end of the tool into a notch defined between the flange on the release actuator and an exterior wall of the release actuator.

8. The method as defined in claim 3, wherein the step of rotating the release actuator further includes:

moving the release actuator along a surface of a detent provided within the interior cavity of the housing.

9. The method as defined in claim 8, wherein the step of moving the release actuator includes:

sliding the release actuator along a curved surface of the detent.

10. The method as defined in claim 8, wherein the region of the release actuator that is contacted is a flange that extends outwardly from an exterior surface of the release actuator, and the step of moving the release actuator further includes:

stopping rotational motion of the release actuator when the flange on the release actuator engages a stop provided within the interior cavity of the housing.

11. The method as defined in claim 8, wherein one or both of the fixed contact and the spring contact are electrically conductive; and wherein the step of inserting the end of the tool further comprises:

shielding the end of the tool from contacting the electrically conductive fixed contact or spring contact when the release actuator is in the first position or the second position.

12. The method as defined in claim 8, wherein the step of inserting the release portion of the release actuator between the fixed contact and the spring contact further includes:

contacting a movable arm of the spring contact with an angled face of the release actuator;

rotating the movable arm away from the fixed contact; and opening a gap between the arm of the spring contact and the fixed contact.

13. The method as defined in claim 1, wherein the step of providing the electrical device with the release actuator further comprises:

providing the release actuator that is a single, unitary, monolithic component.

14. The method as defined in claim 1, wherein the step of providing the electrical device with the release actuator further comprises providing an electrically non-conductive release actuator.

15. The method as defined in claim 1, further comprising:

withdrawing the end of the tool from the release port; and moving the release actuator to the first position by moving the region of the spring contact back to the initial position.

16. The method as defined in claim 1, wherein the step of providing the electrical device comprises providing a circuit breaker.

17. A wire connector assembly for an electrical device; said connector assembly comprising:

a housing having an exterior wall that bounds and defines an interior cavity;

an electrically conductive fixed contact located within the interior cavity of the housing;

an electrically conductive spring contact located within the interior cavity of the housing and having an arm that is movable toward or away from the fixed contact;

an electrically non-conductive release actuator located entirely within the interior cavity of the housing and being rotatable between a first position and a second position when a force is applied thereto; and wherein a region of the release actuator is directly accessible through an opening defined in the exterior wall of the housing; and wherein the release actuator is only activatable through direct contact with the region of the release actuator.

18. The wire connector assembly as defined in claim 17, wherein when the release actuator is in the first position a first end of the release actuator is remote from the fixed contact and the spring contact.

19. The wire connector assembly as defined in claim 18, wherein when the release actuator is in the second position, the first end of the release actuator is located at least partially between the fixed contact and the spring contact.

20. The wire connector assembly as defined in claim 17, wherein the release actuator rotates between the first position and the second position when a linear force is applied thereto.

21. The wire connector assembly as defined in claim 20, wherein the release actuator rotates between the second position and the first position when the linear force is removed and the arm moves back toward the fixed contact.

22. The wire connector assembly as defined in claim 17, wherein the arm rotates away from the fixed contact when the release actuator is moved from the first position to the second position.

23. The wire connector assembly as defined in claim 17, wherein the release actuator comprises:

an arcuate base; where the first end of the release actuator is a first end of the base; and wherein the base has a second end remote from the first end thereof; and the base further includes an interior surface and an exterior surface that extend between the first end and the second end; and the region of the release actuator comprises a flange that extends outwardly from the exterior surface of the base.

24. The wire connector assembly as defined in claim 23, further comprising:

a notch defined between the flange and the exterior surface of the base; and wherein the notch is adapted to receive an end of an actuating tool therein.

25. The wire connector assembly as defined in claim 23, further comprising:

a detent having an arcuate surface that is complementary in curvature to a curvature of the base; and wherein the base engages the detent and moves therealong when a linear force is applied to the base.

26. The wire connector assembly as defined in claim 23, further comprising:

a stop positioned to be engaged by the flange on the base when the base is rotated into the second position.

27. The wire connector assembly as defined in claim 17, wherein the release actuator in the second position creates a gap between the arm and the fixed contact.

28. The wire connector assembly as defined in claim 17, wherein the release actuator is fabricated from an electrically non-conductive material.

29. The wire connector assembly as defined in claim 17, further comprising a housing within which the fixed contact, the spring contact and the release actuator are located; and wherein a front wall of the housing defines a release port therein; and wherein the release actuator is positioned within the housing so as to be contactable with a tool inserted through the release port.

30. The wire connector assembly as defined in claim 17, wherein the housing is part of a housing of a circuit breaker.

31. The wire connector assembly as defined in claim 17, wherein the arm is biased toward the fixed contact.

* * * * *